US011410795B2

(12) United States Patent
Horton et al.

(10) Patent No.: US 11,410,795 B2
(45) Date of Patent: Aug. 9, 2022

(54) POWER CABLE WITH CONDUCTOR STRAND FILL CONTAINING RECYCLED CROSSLINKED COMPOUNDS

(71) Applicant: PRYSMIAN S.p.A., Milan (IT)

(72) Inventors: David Horton, Lexington, SC (US); Tyson Baker, Lexington, SC (US); Chris Dekonkoly, Lexington, SC (US)

(73) Assignee: PRYSMIAN S.p.A., Milan (IT)

( * ) Notice: Subject to any disclaimer, the term of this patent is extended or adjusted under 35 U.S.C. 154(b) by 0 days.

(21) Appl. No.: 17/265,075

(22) PCT Filed: Aug. 2, 2018

(86) PCT No.: PCT/US2018/045012
§ 371 (c)(1),
(2) Date: Feb. 1, 2021

(87) PCT Pub. No.: WO2020/027844
PCT Pub. Date: Feb. 6, 2020

(65) Prior Publication Data

US 2021/0304921 A1 Sep. 30, 2021

(51) Int. Cl.

| | |
|---|---|
| ***H01B 7/288*** | (2006.01) |
| ***H01B 13/32*** | (2006.01) |
| ***H01B 7/285*** | (2006.01) |

(52) U.S. Cl.
CPC ..... *H01B 7/288* (2013.01); *H01B 13/327* (2013.01)

(58) Field of Classification Search
CPC ..... H01B 7/282; H01B 7/288; H01B 7/285; H01B 13/327
See application file for complete search history.

(56) References Cited

U.S. PATENT DOCUMENTS

| | | | | |
|---|---|---|---|---|
| 4,703,132 | A | 10/1987 | Marciano-Agostinelli et al. | |
| 4,791,240 | A * | 12/1988 | Marin | H01B 13/327 174/23 C |
| 6,638,589 | B1 | 10/2003 | Järvenkylä | |
| 7,744,950 | B2 | 6/2010 | Belli et al. | |
| 8,722,787 | B2 * | 5/2014 | Romick | B32B 15/085 524/504 |

(Continued)

OTHER PUBLICATIONS

International Search Report and Written Opinion dated Sep. 27, 2018 in PCT/US2018/045012 filed on Aug. 2, 2018.

(Continued)

*Primary Examiner* — Hoa C Nguyen
*Assistant Examiner* — Amol H Patel
(74) *Attorney, Agent, or Firm* — Oblon, McClelland, Maier & Neustadt, L.L.P.

(57) ABSTRACT

A power cable and a process of manufacturing a power cable, where the power cable includes a core containing stranded electrically conductive wires that are impregnated with a water-blocking composition, wherein the water-blocking composition contains, based on a total weight of the water-blocking composition: (i) a thermoplastic polymer; and (ii) a positive amount of up to 30 wt % of a crosslinked polymer, where the crosslinked polymer is in the form of a powder having a particle diameter less than 900 μm and the crosslinked polymer is dispersed in the thermoplastic polymer.

16 Claims, 2 Drawing Sheets

(56) References Cited

U.S. PATENT DOCUMENTS

| | | | | |
|---|---|---|---|---|
| 2009/0220817 | A1* | 9/2009 | Kato | H01B 7/288<br>428/626 |
| 2016/0326759 | A1* | 11/2016 | Huh | E04G 23/0211 |
| 2018/0010850 | A1 | 1/2018 | Moore | |

OTHER PUBLICATIONS

Extended European Search Report dated Feb. 17, 2022 in corresponding European Patent Application No. 18928336.9, 7 pages.
Office Action dated Apr. 6, 2022, in corresponding Chinese Application No. 201680096200.8 (with English translation).

* cited by examiner

POWER CABLE WITH CONDUCTOR STRAND FILL CONTAINING RECYCLED CROSSLINKED COMPOUNDS

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

STATEMENT REGARDING PRIOR DISCLOSURES BY THE INVENTOR OR A JOINT INVENTOR

Not applicable.

BACKGROUND OF THE INVENTION

Field of the Invention

This disclosure relates to a power cable comprising an electrically conductive core made of a plurality of wires that are stranded and impregnated with a water-blocking composition, where the water-blocking material comprises (i) a thermoplastic polymer and (ii) up to 30 wt % of a recycled crosslinked polymer, based on a total weight of the water-blocking material, and a process for manufacturing said cable cores. This disclosure further relates to power cables comprising said electrically conductive core for use in underground and submarine environments.

Description of the Related Art

The penetration of water into the electrically conductive core of a power cable is problematic because the water can vaporize due to the temperatures reached during the use of the conductor and migrate into the insulation of the power cable where "trees" may form potentially causing a decrease in the electrical properties of the insulation and an increased risk of electrical perforation. The water penetration issue is particularly felt in underground and underwater cable deployments where the risks of the entry and spreading of water along the entire cable are very high. Water that penetrates the electrically conductive core is also problematic because it can cause corrosion of the metal wires forming the conductive core.

To prevent the migration along the conducing core of insulated electric cables, U.S. Pat. No. 4,791,240 proposes an electric cable comprising a conductor in the form of a rope constituted by a plurality of metallic wires laid up together and impregnated with a filler that, when extruded, forms a solid and hard compound between the metallic wires. The filler compound is based on a polymeric compound having a Mooney viscosity from about 10-60 at 100° C. and a Shore A hardness from about 10-90.

Known water-blocking materials (also referred to as strand fill materials) tend to be expensive and include commodities that fluctuate in price, such as graphite and rubber compounds.

Electric cables comprise layers made of compositions based on crosslinked polymers that are obtained from a peroxide or silane crosslinking process, such as ethylene propylene rubber (EPR), cross-linked polyethylene (XLPE) and optional additives. The waste streams of these cross-linked, partially crosslinked and uncrosslinked scraps thereof are not insignificant. Contrarily to thermoplastic materials, like the strand fill materials, crosslinked and partially crosslinked cannot be re-melted and re-used. Thus, aside from the environmental footprint of these waste streams, production costs are increased because of the disposal of these waste streams.

It would be advantageous to reduce the cost and reliance on known water-blocking materials through the use of cheaper polymeric materials. However, the incorporation of non-thermoplastic materials, such as thermosets and cross-linked polymeric materials, into thermoplastic compositions is problematic because they have different viscosities and this difference in viscosity can result in a heterogenous mixture potentially affecting the processing conditions needed to ensure complete impregnation of the interstices and, accordingly the cable protection. In the case of the addition of a crosslinked or partially crosslinked recycled polymeric material, reheating cannot achieve softening or melting, thus it would be expected to increase the likelihood of water being able to migrate along the conductive core of the cable due to voids that may form at the interfaces of the thermoplastic water-blocking material and the crosslinked polymeric material. That is, the different phases of the crosslinked polymer and the water-blocking material during the impregnating process would be expected to contribute to interface voids.

U.S. Pat. No. 4,123,584 discloses a process for recovering solid scrap thermosetting types of plastic compounds by: hot granulating the fresh scraps before they fully cure; cooling the granules to avoid further curing; and then, forming a fine powder of about 18 mesh (1 mm) or less from the granules. U.S. Pat. No. 4,123,584 proposes to use the reclaimed thermosetting compound in insulation coatings for electrical conductors by: extruding the reclaimed compound onto an electrical conductor; curing the coated conductor by passing it through a continuous vulcanization tube; and then cooling the cured, coated conductor. It is essential in U.S. Pat. No. 4,123,584 that the reclaimed thermosetting compound is not entirely cured, although it is indicated that substantially cured compounds may be reused in some less exacting processes, such as injection molding and the extrusion of thick insulation coatings, if it is blended with at least 25 wt % of virgin material.

The exemplary process in U.S. Pat. No. 4,123,584 relates to a blend made of 90 wt % of a very low cured crosslinkable polyethylene and 10 wt % of a reclaimed crosslinked polyethylene. The use of a recycled blend in a water-blocking material is not envisaged nor is recycling of the partially crosslinked thermosetting polymer with a thermoplastic polymer.

U.S. Pat. No. 6,638,589 discloses a method of using recycled plastic material by mixing crosslinked polyethylene with the base material, e.g., a polyolefin, of the product to be produced, in such a way that the proportion of the recycled crosslinked polyethylene in the mixture is less than 30 wt %. The crosslinked polyethylene is ground by grating and tearing to form a powder that has a grain size of less than 1 mm and that, when extruded, does not melt with the base material and orientates so that its strength continues to grow to some extent. U.S. Pat. No. 6,638,589 exemplifies the formation of plastic pipes from the blend containing the recycled crosslinked polyethylene. U.S. Pat. No. 6,638,589 does not envisage the use of the recycled blend as a water-blocking material or in the manufacture of cables.

SUMMARY OF THE INVENTION

An object of the present disclosure is to reduce the cost of manufacturing a power cable having an electrically conductive core comprising a water-blocking composition suitable to prevent ingress and migration of water through the conductive core without substantially altering the cable manufacturing efficiency, for example in term of ease and speed.

Applicant envisaged incorporating an at least partially crosslinked scrap material into the thermoplastic water-blocking material. The reuse of the scrap material reduces the costs of production by decreasing the disposal costs associated with crosslinked polymers obtained from peroxide or silane curing processes and the relative amount of the thermoplastic water-blocking material commonly used in stranding process of the electrically conductive core.

Applicant found that a given amount of an at least partially crosslinked material in admixture with a thermoplastic water-blocking material could be used for fully impregnating the electrical conductor wires of a power cable at an industrially satisfactory manufacturing speed, when the at least partially crosslinked material is in form a powder with a particle diameter of less than 900 μm.

An object of the present disclosure is achieved with a power cable comprising stranded electrically conductive wires that are impregnated with a water-blocking composition comprising:

(i) a thermoplastic polymer; and (ii) a positive amount of up to 30 wt %, based on a total weight of the water-blocking composition, of a crosslinked polymer, wherein the crosslinked polymer is in the form of a powder having a particle diameter less than 900 μm, and wherein the crosslinked polymer is dispersed in the thermoplastic polymer.

The present disclosure further relates to a process for manufacturing a power cable, which comprises:

dispersing up to 30 wt % of a crosslinked polymer in the form of a powder having a particle diameter less than 900 μm in a thermoplastic polymer to obtain a water-blocking composition;

pumping the water-blocking composition to impregnate stranded electrically conductive wires, to obtain a cable core;

wherein the pumping is carried out at a line speed greater than 250 RPM (rotation per minute).

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
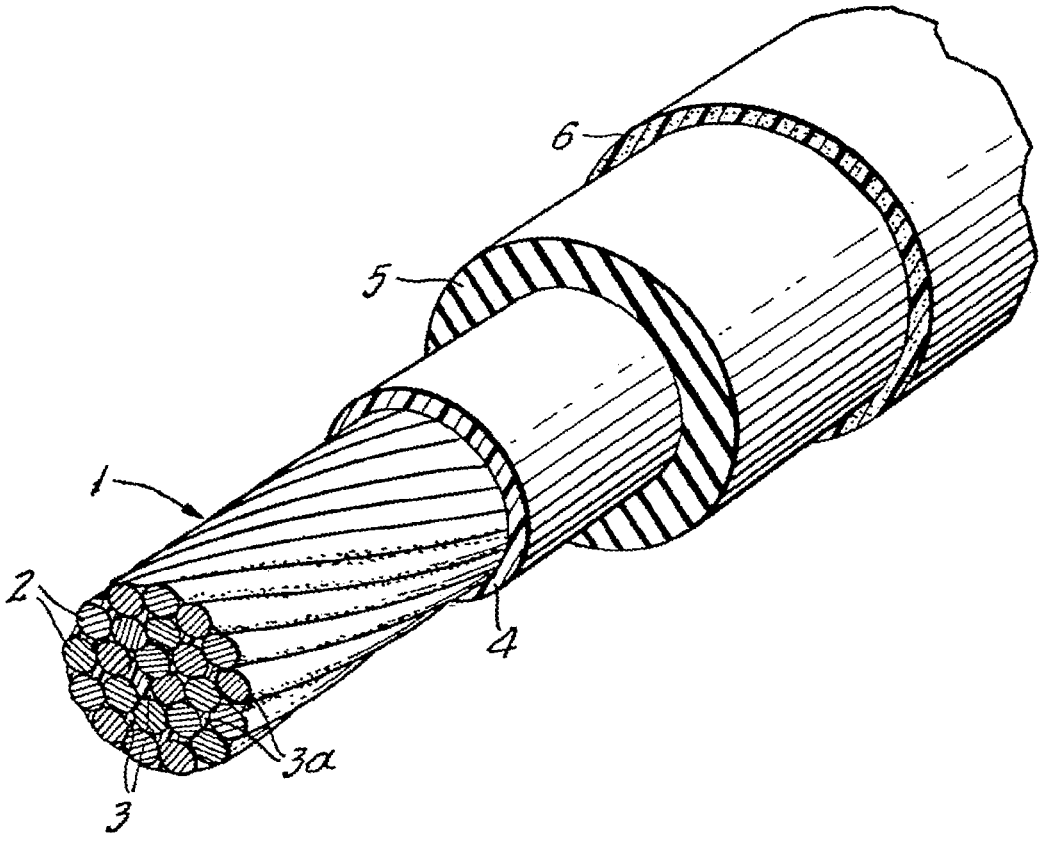
FIG. 1 is a perspective view of a cable according to the present disclosure.

It is to be understood that all the possible combinations of particular features of the objects of the present disclosure are included in this specification. For example, where a particular feature is disclosed in the context of a particular aspect or embodiment, or a particular claim, that feature can also be used, to the extent possible, in combination with and/or in the context of other particular aspects and embodiments, and in the disclosure generally.

The numerical ranges in this disclosure are approximate, and thus may include values outside of the range unless otherwise indicated. Numerical ranges include all values from and including the lower and the upper values, in increments of one unit, provided that there is a separation of at least two units between any lower value and any higher value. As an example, if a compositional, physical or other property, such as, for example, molecular weight, viscosity, melt index, etc., is from 100 to 1,000, it is intended that all individual values, such as 100, 101, 102, etc., and sub ranges, such as 100 to 144, 155 to 170, 197 to 200, etc., are expressly enumerated. For ranges containing values which are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. These are only examples of what is specifically intended, and all possible combinations of numerical values between the lowest value and the highest value enumerated, are to be considered to be expressly stated in this disclosure. Numerical ranges are provided within this disclosure for, among other things, the component amounts of the composition and various process parameters.

"Composition" means a mixture or blend of two or more components.

"Polymer" means a compound containing more than 4 monomer units of the same or different type. The term "polymer" includes homopolymers, copolymers, terpolymers, interpolymers, and so on.

"Thermoplastic polymer" means a polymer capable of being repeatedly softened by heating and hardened by cooling through a characteristic temperature range, wherein the change upon heating is substantially physical; as opposed to a "thermosetting polymer," which is a polymer that "sets" irreversibly when cured, typically due to a crosslinking reaction of the constituents, to form a substantially infusible or insoluble product also known as a "thermoset." Examples of thermoplastic polymers include, by way of illustration only, end-capped polyacetals, such as poly(oxymethylene) or polyformaldehyde, poly(trichloroacetaldehyde), poly(n-valeraldehyde), poly(acetaldehyde), poly(propionaldehyde), and the like; acrylic polymers, such as polyacrylamide, poly(acrylic acid), poly(methacrylic acid), poly(ethyl acrylate), poly(methyl methacrylate), and the like; fluorocarbon polymers, such as poly(tetrafluoroethylene), perfluorinated ethylene-propylene copolymers, ethylene-tetrafluoroethylene copolymers, poly(chlorotrifluoroethylene), ethylene-chlorotrifluoroethylene copolymers, poly(vinylidene fluoride), poly(vinyl fluoride), and the like; polyamides, such as poly(6-aminocaproic acid) or poly(epsilon-caprolactam), poly(hexamethylene adipamide), poly(hexamethylene sebacamide), poly(11-aminoundecanoic acid), and the like; polyaramides, such as poly(imino-1,3-phenyleneiminoisophthaloyl) or poly(m-phenylene isophthalamide), and the like; parylenes, such as poly-p-xylylene, poly(chloro-p-xylylene), and the like; polyaryl ethers, such as poly(oxy-2,6-dimethyl-1,4-phenylene) or poly(p-phenylene oxide), and the like; polyaryl sulfones, such as poly(oxy-1,4-phenylenesulfonyl-1,4-phenyleneoxy-1,4-phenylene-isopropylidene-1,4-phenylene), poly(sulfonyl-1,4-phenyleneoxy 1,4-phenylenesulfonyl-4,4'-biphenylene), and the like; polycarbonates, such as poly(bisphenolA) or poly(carbonyldioxy-1,4-phenyleneisopropylidene-1,4-phenylene), and the like; polyesters, such as poly(ethylene terephthalate), poly(tetramethylene terephthalate), poly(cyclohexylene-1,4-dimethylene terephthalate) or poly(oxymethylene-1,4-cyclohexylenemethyleneoxyterephthaloyl), and the like; polyaryl sulfides, such as poly(p-phenylene sulfide) or poly(thio-1,4-phenylene), and the like; polyimides, such as poly(pyromellitimido-1,4-phenylene), and the like; polyolefins, such as polyethylene, polypropylene, poly(l-butene), poly(2-butene), poly(l-pentene), poly(2-pentene), poly(3-methyl-1-pentene), poly(4-methyl-1-pentene), 1,2-poly-1,3-butadiene, 1,4-poly-1,3-butadiene, polyisoprene, polychloroprene, polyacrylonitrile, poly(vinyl acetate), polystyrene, and the like.

"Crosslinkable" and "curable" mean that the polymer is not cured or crosslinked and has not been subjected or exposed to treatment that has induced substantial crosslinking although the polymer comprises additive(s) or functionality which will cause or promote substantial crosslinking upon subjection or exposure to such treatment.

"Fully cured" or "fully crosslinked" means the polymer/crosslinker system has effectively developed the maximum practical viscosity under the particular conditions of use, unless indicated otherwise or clear from the context within which the term is used. The degree of cure can be described in terms of gel content, or conversely, extractable components. Gel content reported as percent gel is determined by a procedure which comprises determining the amount of insoluble polymer by soaking the crosslinked polymer for 48 hours in organic solvent at room temperature, weighing the dried residue, and making suitable corrections based upon knowledge of the composition. Thus, corrected initial and final weights are obtained by subtracting from the initial weight the weight of soluble components, other than polymer to be crosslinked, such as extender oils, plasticizers and components of the composition that are soluble in the organic solvent. Any insoluble pigments, fillers, and the like are subtracted from both the initial and final weights. Generally, fully crosslinked means that less than 10% by weight of the crosslinked polymer is extractable by an organic solvent. In another embodiment, the amount of organic solvent extractable is less than 5% by weight, less than 3% by weight, less than 2% by weight, or less than 1% by weight. Alternatively, fully crosslinked means that the crosslinked polymer has a gel content of greater than 90%, greater than 95%, greater than 97%, greater than 98%, or greater than 99%.

"Polyolefin" means a polymer containing units derived from at least one type of olefin, typically a $C_2$-$C_{20}$ olefin, such as ethylene, propylene, butylene, pentene, hexene, octene, etc.

The objects of the present disclosure are obtained by a power cable that comprises a core comprising stranded electrically conductive wires that are impregnated with a water-blocking composition, wherein the water-blocking composition comprises, based on a total weight of the water-blocking composition:

(i) a thermoplastic polymer; and (ii) a positive amount of up to 30 wt % of at least one crosslinked polymer, wherein the crosslinked polymer is in the form of a powder having a particle diameter less than 900 μm, and wherein the crosslinked polymer is dispersed in the thermoplastic polymer.

Thermoplastic Polymer

Examples of the thermoplastic polymers included in the water-blocking composition are based on thermoplastic polyolefins, such as polyethylene homopolymers, polyethylene copolymers (e.g., ethylene-propylene copolymer), isobutylene homopolymers, and isobutylene copolymers, butadiene-styrene copolymers, or on polyesters such as ethyl vinyl acetate polymers.

The amount of the thermoplastic polymer in the water-blocking composition may range from 20 to 90 wt %, from 20 to 85 wt %, from 65 to 85 wt %.

Crosslinked Polymer

Crosslinked polymers are relatively immobile when subjected to shear, whereas low viscosity fluids, such as thermoplastic polymers, flow relatively easily. In addition, as the particle diameter of the crosslinked polymer increases and the number of particles decreases, there is less resistance to flow because there are less particle-particle interactions restricting the flow, while decreases in the particle diameter and increases number of particles results in more particle-particle interactions that increase the resistance to flow. Increases in the resistance to flow results in inhomogeneous distributions of the crosslinked polymer in the thermoplastic polymer, which impairs the ability of the water-blocking composition to prevent ingress and migration of water through the conductive core at an industrially acceptable manufacturing speed.

The crosslinked polymer is in the form of a powder having a particle diameter of less than 900 μm. The crosslinked polymer powder is dispersed in the thermoplastic polymer of the disclosure. In certain embodiments, the particle diameter of the powder is from 100 μm to 600 μm, or from 200 μm to 400 μm. The upper limit of the particle diameter of the crosslinked polymer is 900 μm since diameters greater than 900 μm result in defects in the water-blocking composition and impairs its ability to prevent ingress and migration of water through the conductive core.

The crosslinked polymer is included in the water-blocking composition in a positive amount of up to 30 wt %, based on the total weight of the water-blocking composition. In certain embodiments, the content of crosslinked polymer is at least 10 wt % or at least 15 wt %. Although amounts greater than 30 wt % of the crosslinked polyolefin may be included in the water-blocking composition, amounts greater than 30 wt % are unsuitable for an industrially efficient manufacturing process because breakages occur in the water-blocking composition when utilized with line speeds exceeding 250 rotations per minute. In certain embodiments, the upper limit of the crosslinked polymer is 28 wt %, 25 wt %, 22.5 wt %, or 20 wt %. For example, the content of crosslinked polymer included in the water-blocking composition, ranges from 10 wt % to 25 wt % based on a total weight of the water-blocking composition.

The crosslinked polymer may be a recycled crosslinked polymer.

In certain embodiments, the crosslinked polyolefin is a crosslinked polyolefin, for example a homopolymer of ethylene or copolymer of ethylene with one or more comonomers, such as a crosslinked LDPE, VLDPE, LLDPE, MDPE, or HDPE, or a mixture of such polymers. Additional crosslinked polymers include ethylene-propylene rubber (EPR) and ethylene propylene diene rubber (EPDM), ethylene vinyl acetate (EVA), ethylene butyl acetate (EBA), and ethylene ethyl acetate (EEA).

The crosslinked polymer may be crosslinked with a crosslinking agent such as sulfur, peroxide, or a silane. In certain embodiments, the crosslinked polymer is crosslinked via silane groups, where said silane groups can be introduced into the polyolefin structure by copolymerization of monomers, such as olefin monomers, with silane-moiety bearing comonomers, or by grafting crosslinkable silane-moieties bearing compounds, such as unsaturated silane compounds with hydrolysable silane group(s), onto the polyolefin. Grafting is usually performed by radical reaction using free radical generating agents. In both the copolymerization and grafting methods, the unsaturated silane compound may be represented by the formula (I):

$$RSiR'_nY_{3-n} \quad (I),$$

wherein:

R is an ethylenically unsaturated hydrocarbyl or hydrocarbyloxy group;

R' is an aliphatic, saturated hydrocarbyl group;

Y is a hydrolysable organic group, where plural Y groups may be the same or different; and n is 0, 1, or 2.

Specific examples of the unsaturated silane compound are those in which R is vinyl, allyl, isopropenyl, butenyl, cyclohexenyl, or gamma-(meth)acryloxypropyl, Y is methoxy, ethoxy, formyloxy, acetoxy, propionyloxy, or an alkyl or arylamino group, and R' is a methyl, ethyl, propyl, decyl or phenyl group. For instance, the unsaturated silane compound may have formula $CH_2{=}CHSi(OA)_3$, wherein A is a hydrocarbyl group having 1-8 carbon atoms or 1-4 carbon atoms. Specific silanes include vinyltrimethoxy silane, vinyl dimethoxyethoxy silane, vinyltriethoxy silane, gamma-(meth)acryl-oxypropyl silane, and vinyltriacetoxy silane.

In certain embodiments, the crosslinked polymer is crosslinked via radical reaction with a peroxide. Examples of peroxides used for crosslinking are di-tert-amylperoxide, 2,5-di(tert-butylperoxy)-2,5-dimethyl-3-hexyne, 2,5-di(tert-butylperoxy)-2,5-dimethylhexane, tert-butylcumylperoxide, di(tert-butyl)peroxide, dicumylperoxide, di(tert-butylperoxy-isopropyl)benzene, butyl-4,4-bis(tert-butylperoxy) valerate, 1,1-bis(tert-butylperoxy)-3,3,5-trimethylcyclohexane, tert-butylperoxybenzoate, dibenzoyl-peroxide.

The crosslinking agents (e.g., the unsaturated silane compounds and peroxide compounds), are generally added to the crosslinkable polyolefin in an amount from 0.1 to 10 wt %, or from 0.1 to 5 wt %.

In an embodiment, the thermoplastic polymer and/or the crosslinked polymer of the water-blocking composition can be semiconductive, thus making the water-blocking composition of the disclosure semiconductive. In the case of the crosslinked polymer, it can be a waste material from cable semiconductive layer manufacturing. A semiconductive thermoplastic polymer and/or the crosslinked polymer can contain an electrically conductive filler, such as carbon black or graphite or a mixture thereof.

Representative electrically conductive fillers have a surface area BET greater than 20 $m^2/g$, for example of from 40 and 500 $m^2/g$.

The electrically conductive filler can be present in the thermoplastic polymer and/or in the crosslinked polymer in an amount suitable to achieve the desired conductivity, which is usually below 1000 ohm·m, below 500 ohm·m, or of about 1 ohm·m. The amount of conductive filler can range from 5 to 50 wt %, for example from 10 to 40 wt %, based on the total weight of the semiconductive thermoplastic polymer or of the semiconductive crosslinked polymer. This amount can depend on the specific conductive feature of the filler, as known to those of skill in the art.

Additives

The water-blocking composition may include additives, such as water-swellable material, antioxidants, crosslinking boosters, scorch retardants, processing aids, fillers, crosslinking agents, ultraviolet absorbers, stabilizers, antistatic agents, nucleating agents, slip agents, plasticizers, lubricants, viscosity control agents, tackifiers, anti-blocking agents, surfactants, extender oils, acid scavengers and/or metal deactivators. The content of said additives may ranges from 0 to 10 wt % or from 0 to 5 wt %, based on a total weight of the water-blocking composition.

As for the swellable material, it can be in form of powders based on organic material such as polyacrylates and polyacrylamides, either in se or grafted on natural polymers such as the amides, cellulose and esters of methyl-cellulose and the ethers of cellulose, such as, carboxymethyl cellulose.

Water-Blocking Composition

The water-blocking composition may be prepared by mixing the electrically conductive filler and any additives with the thermoplastic polymer, to obtain an electrically conductive thermoplastic composition, and then mixing the crosslinked polymer with the electrically conductive thermoplastic composition using a mixtruder that includes a double arm or a sigma blade mixer with an extruder. Alternatively, the water-blocking composition may be prepared by mixing the electrically conductive filler, any additives, and the crosslinked polymer with the thermoplastic polymer using a mixtruder. The mixture of the crosslinked polymer and the thermoplastic polymer are heated before impregnation of the core comprising stranded electrically conductive wires.

The crosslinked polymer may be a recycled crosslinked polymer. The recycled crosslinked polymer may be obtained from subsequent layers of the power cable described below. The recycled crosslinked polymer can be prepared by shredding and pulverizing a crosslinked polymer and passing the pulverized crosslinked polymer through screen to the desired particle diameter.

Referring now to the drawings, wherein like reference numerals designate identical or corresponding parts throughout the several views.

Power Cable

Figure 2:
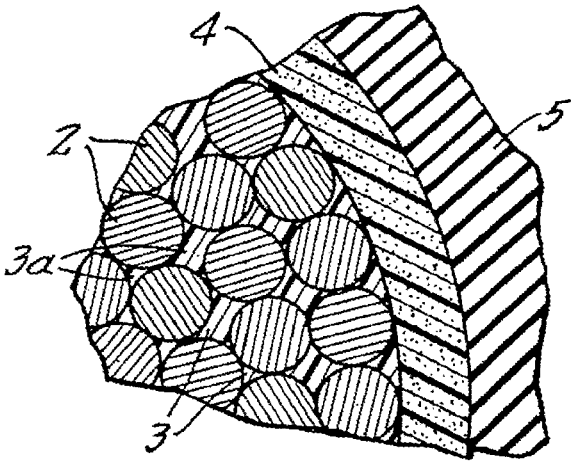
FIG. 2 is a fragmentary, enlarged cross-section of a cable according to the present disclosure.

A cable of the present disclosure is illustrated in FIGS. 1 and 2, and comprises (from the inside towards the outside), an electric conductor 1 in the form of a rope comprising a plurality of metallic wires 2 made, for example, of copper, aluminum, or aluminum alloy and which are stranded together.

The individual metallic wires 2, except for those forming the outermost layer of the rope (as shown in FIG. 2), are completely surrounded by a water-blocking composition 3*a*, which must avoid the moisture penetration and migration along of the electric conductor 1. It is essential that all of the spaces 3 in-between the metallic wires 2 are completely filled up with the water-blocking composition 3*a*.

Typically, an inner semiconductive layer 4 is provided around the electric conductor 1. The inner semiconductive layer 4 engages the outermost surfaces of the electric conductor 1 and may directly contact the outermost surface of wires 2. Water swellable material may be applied at the interface between the inner semiconductive layer 4 and the outermost surface of wires 2. Such water swellable material may be in form of powder, strands or tapes, and may be based on polyacrylates and polyacrylamides, either in se or grafted on polymers such as the amides, cellulose and esters of methyl-cellulose and the ethers of cellulose, such as, carboxymethyl cellulose.

An electrically insulating layer 5 is disposed around the inner semiconductive layer 4. The electrical insulating layer 5 provides electrical insulation around the cable core 1 and may directly contact the inner semiconductive layer 4.

An outer semiconductive layer 6 is disposed around the insulating layer 5 and may directly contact the insulating layer 5.

The inner semiconductive layer 4, the electrically insulating layer 5, and the outer semiconductive layer 6 may be coextruded or extruded separate from one another. If extruded separately, the electrically insulating layer 5 is extruded onto the inner semiconductive layer 4 before it cools and then the outer semiconductive layer 6 is extruded onto the electrically insulating layer 5 before it cools to increase the adhesion between the respective layers.

The inner semiconductive layer 4, the electrically insulating layer 5, and the outer semiconductive layer 6 comprise at least one polymer selected from the group consisting of a polyethylene homopolymer, a polyethylene copolymer, a polypropylene homopolymer, a polypropylene copolymer. Exemplary polyethylene polymers include low density polyethylene (LDPE), linear low density polyethylene (LLDPE), crosslinked polyethylene (XLPE), ethylene/vinyl acetate (EVA), ethylene butyl acetate (EBA), ethylene ethyl acetate (EEA), ethylene-propylene rubber (EPR), ethylene propylene diene rubber (EPDM). In certain embodiments, the inner semiconductive layer 4, the electrically insulating layer 5, and the outer semiconductive layer 6 are all formed of the same polymer, with the proviso that the semiconductive layers comprise a conductive filler and the insulating layer does not. In certain embodiments, at least one of the inner semiconductive layer 4, the electrically insulating layer 5, and the outer semiconductive layer 6 comprises a crosslinked polymer that is compositionally the same as the crosslinked polymer in the water-blocking composition.

The inner semiconductive layer 4, the electrically insulating layer 5, and the outer semiconductive layer 6 may comprise any of the additives mentioned with respect to the water-blocking composition.

The inner semiconductive layer 4 and the outer semiconductive layer 6 further include a suitable amount of an electrically conductive filler to impart semiconductive properties. The details of the electrically conductive filler are the same as mentioned above with respect to the water-blocking composition.

The insulating layer 5 does not include an electrically conductive filler or in the event that the insulating layer 5 includes an electrically conductive filler, it is included in an amount that does not provide the insulating layer 5 with semiconductive properties. Tree retardant additives can be added to XLPE to inhibit the growth of water trees in the insulation layer.

Together, the inner semiconductive layer 4, the insulating layer 5, and the outer semiconductive layer 6 form an insulating system that surrounds the electric conductor 1. The combination of the electric conductor 1 and the insulating system can be referred to as an insulated conductor.

Around the outer semiconductive layer 6 of the insulated conductor, other per se known elements (not shown) can also be provided, such as, for example, a screen, a water blocking barrier, protective layer(s), armoring layer(s), etc. For instance, a metallic shield comprising a metallic screen or sheath layer may be provided. The metallic screen or sheath layer is made of aluminum, steel, lead, or copper and is in the form of wires, braids, a helically wound tape, or a longitudinally folded foil.

Figure 3:
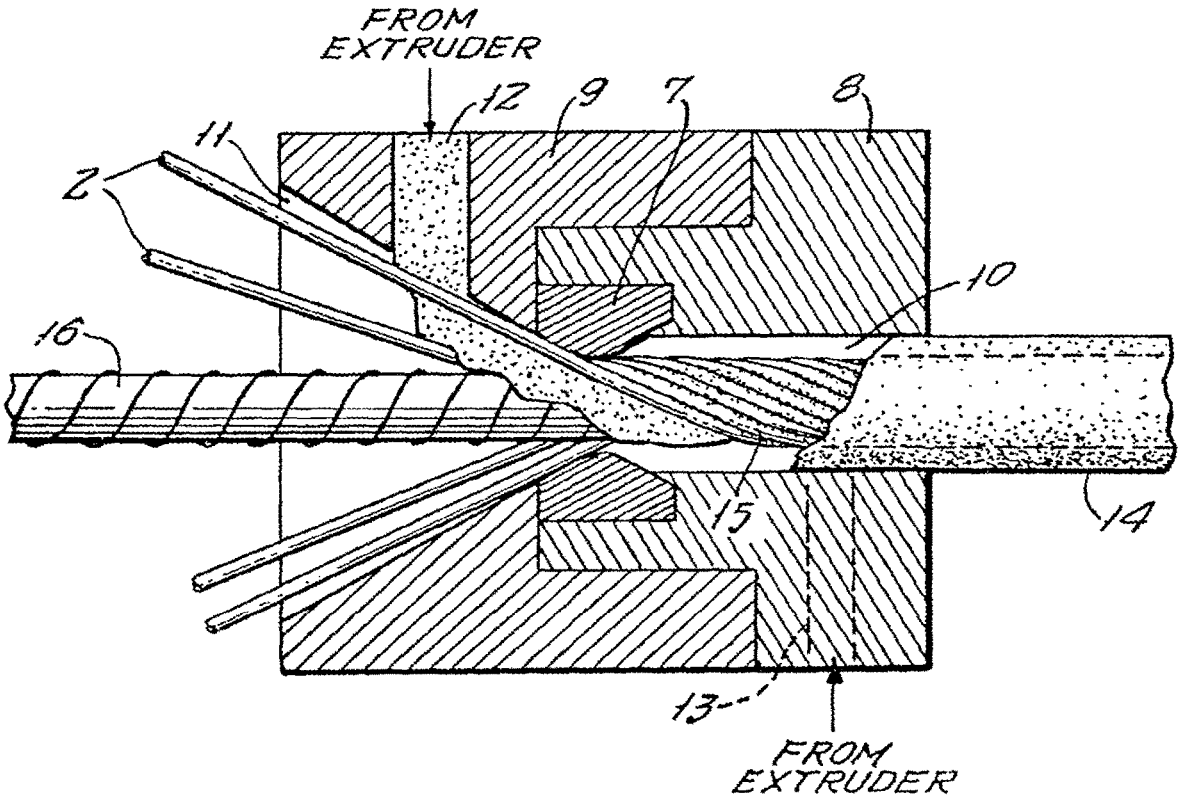
FIG. 3 is a schematic, side view of a device for carrying out the method for making a cable according to the present disclosure.

FIG. 3 schematically shows a side elevation view, partly in cross-section, of a device for forming the electric conductor 1. The device comprises an annular die 7 secured to and coaxial with a cylindrical body which is formed by two parts 8 and 9 which are joined together and which has a through-cavity. The part 8 of the cylindrical body has a cylindrical shaped cavity 10 through which the rope portion 15, formed in the device, passes. The wires 2, intended for forming the outermost layer of the rope portion 15 which was produced in the device, and the core 16 of the rope produced previously with an identical device and already impregnated with the water-blocking composition pass through the cavity 11.

The part 9 of the cylindrical body has a truncated cone shaped inner cavity 11 which, in correspondence to the lesser base thereof, extends to the cavity of the annular die 7. In the part 9 of the cylindrical body, there is a through-hole 12 communicating with an extruder (not shown) which delivers the water-blocking composition of the present disclosure into the truncated-cone cavity 11.

The wires 2, and the core 16 of the rope previously formed and already impregnated with the water-blocking composition, advance in a continuous manner toward the annular die 7. During said advance, the wires 2 and the core 16 drag along with them the water-blocking composition which the extruder has delivered by means of the through-hole 12 into the truncated-cone cavity 11, and said composition passes through the wires 2 as they approach the core 16 of the rope.

The water-blocking composition is prevented by the wires 2 and the core 16 from passing through the annular die 7 (where the joining and the compacting of the plurality of wires 2 on the already impregnated core 16 takes place), fills up all the spaces existing between the wires and assuring that at least one layer of the water-blocking composition exists between the wires 2 and the wires which are disposed in the radially outermost portion of said core 16.

The device of FIG. 3 may also be provided with another through hole 13 (indicated with a broken line) in the part 8 of the cylindrical body which also communicates with the extruder for forming a layer 14 of the water-blocking composition around the already formed portion 15.

If another layer of wires 2 is to be applied over the structure leaving the device shown in FIG. 3, the other layers of wires 2 may be applied over such structure by a second device the same as the device shown in FIG. 3 and disposed downstream thereof, but if a layer 14 of the water-blocking composition is not to be applied to the exterior of the rope at the second device, the through hole 13 may be omitted.

A cable according to the present disclosure can be manufactured at industrially efficient line speed. In particular the stranded electrically conductive wires of the cable core can be impregnated by the present water-blocking composition cable at a line speed greater than 250 RPM, for example of at least 400 RPM.

Examples

Hot and cold bend water penetration resistance tests were performed in accordance with ANSI/ICEA T-31-610-2014, section 3.2.2.

Example 1. A blend containing a semiconducting thermoplastic water-blocking material (Chase $BlH_2Ock$® sold by Chase Wire & Cable Materials, Westwood, Mass.) and 23.0 wt % of pulverized silane crosslinked polyethylene XLPE was prepared with an industrial mixtruder specially designed for the mixing of highly viscous materials. The crosslinked polyethylene XLPE had a particle size of about 295 μm. The mixtruder includes a double arm, or sigma, blade mixer with an extruder to facilitate the removal of the mastic after the mixing has taken place.

The blend was applied to a 42.4 $mm^2$ (1/0 AWG) conductor by pumping the blend through a heated hose and die at a line speed of 450 RPMs (rotation per minute). An XLPE insulation system was extruded over the so-filled conductor. The cable was left unsheathed for performing the water penetration test.

0.9 m (36") long samples of the above cable were bent around a 20.32 cm (8") diameter drum after performing a 130° C. hot treatment, while other similar samples were bent around a 20.32 cm (8") diameter drum after performing a −10° C. cold treatment. The bent samples were then allowed to return to room temperature overnight before being subjected to about 0.1 MPa (15 psi) water penetration test per section 3.2.2 of ANSI/ICEA T-31-610-2014. All of the samples passed the test.

Another similar sample cable passed the water penetration test of ICEA S94-649-2013, section 2.2 performed at a water pressure of 0.1 MPa (15 psi) which is greater than the prescribed by said standard, i.e. 0.034 MPa (5 psi).

While the exact water penetration length for each sample was not known, the hot and cold bend tests results confirm that the addition of pulverized crosslinked polymer did not affect the water-blocking compositions ability to impregnated the conductor and efficiently preventing ingress and migration of water in a 1/0 AWG size cable.

Example 2. A cable similar to that of Example 1 (comprising a blend containing a semiconducting thermoplastic water-blocking material and 23.0 wt % of pulverized silane crosslinked polyethylene XLPE with a particle size of about 295 μm) was manufactured and tested except that the blend was applied to a 500 $mm^2$ (1000 kcm) conductor. Two 0.9 m (36") long sample samples were subjected, respectively, to the hot bend test and the cold bend tests as above, but bent around a 50 cm (20") diameter drum. Both the samples passed the test.

The 500 $mm^2$ size cable passed the water penetration test of ICEA S94-649-2013, section 2.2 performed at a water pressure of 0.1 MPa (15 psi) which is greater than that prescribed by said standard, i.e. 0.034 MPa (5 psi).

While the exact water penetration length for each sample was not known, the hot and cold bend tests results confirm that the addition of pulverized crosslinked polymer did not affect the water-blocking composition ability to impregnated the conductor and efficiently preventing ingress and migration of water in a 500 $mm^2$ size cable.

Example 3 A water-blocking composition containing 32.6 wt % of pulverized crosslinked XLPE was used to manufacture a 42.4 $mm^2$ (1/0 AWG) size cable at various line speeds starting from that generally suitable for industrial application, i.e. 450 RPMs. The results are shown below in Table 1.

TABLE 1

| Line Speed (RPMs) | Result |
|---|---|
| 450 | Breakages in the water-blocking material observed. Breakages were not alleviated by adjustment of the strandseal pump. |
| 310 | Breakages in the water-blocking material observed |
| 278 | Breakages in the water-blocking material observed |
| 250 | No breakages observed in the water-blocking material |

The starting portion of about 300 m (1,000 ft.) manufactured at 450 RPMs was not acceptable due to the excessive amounts of strand seal breaks. The manufacturing speed was progressively slowed down and a portion of about 600 (2,000 ft.) obtained at 250 RPMs was finally acceptable for subsequent testing.

As shown in Table 1, concentrations of up to about 33 wt % of the crosslinked XLPE could be incorporated into the virgin water-blocking material so long as the run speed did not exceed 250 RPMs. However, regular cable manufacturing line speeds (i.e., >300 RMPs) could not be used without breakage of the water-blocking material, making a water-blocking composition containing such an amount of pulverized crosslinked polymer unsuitable for an industrially efficient manufacturing process.

Example 4 The following additional samples of 1/0 AWG cables were prepared in the same manner as Example 1 except that the mixtures contained 32.6% of pulverized silane crosslinked polyethylene XLPE and that the sample was prepared at a manufacturing speed of 250 RPMs 0.9 m (36") long samples of the above were bent around a 20.32 cm (8") diameter drum after performing a 140° C. hot treatment, while other similar samples were bent around a 20.32 cm (8") diameter drum after performing a −10° C. cold treatment. The bent samples were then allowed to return to room temperature overnight before being subjected to about 0.1 MPa (15 psi) water penetration test per section 3.2.2 of ANSI/ICEA T-31-610-2014. While the samples bent under hot treatment passed the water penetration test, one sample out of three samples bent under cold treatment failed the test. A cable with the conductor filled with a water-blocking composition containing an amount of crosslinked polymer greater than 30 wt % should be manufactured at a line speed slower than an industrially acceptable one and showed to be not fully reliable in the presence of water.

Modifications and variations of the present disclosure are possible in light of the above teachings. It is therefore to be understood that within the scope of the appended claims, the disclosure may be practiced otherwise than as specifically described herein.

The invention claimed is:

1. A power cable comprising stranded electrically conductive wires impregnated with a water-blocking composition comprising:

a thermoplastic polymer; and a positive amount of up to 30 wt %, based on a total weight of the water-blocking composition, of a crosslinked polymer, in the form of a powder having a particle diameter less than 900 μm, dispersed in the thermoplastic polymer, wherein the crosslinked polymer is selected from crosslinked low density polyethylene, crosslinked very low density polyethylene, crosslinked linear low density polyethylene, crosslinked medium density polyethylene, crosslinked high density polyethylene, ethylene-propylene rubber, ethylene propylene diene rubber, ethylene vinyl acetate, ethylene butyl acetate, ethylene ethyl acetate, or mixtures thereof.

2. The power cable of claim 1, wherein the water-blocking composition comprises at least 10 wt % of the crosslinked polymer based on a total weight of the water-blocking composition.

3. The power cable of claim 1, wherein the water-blocking composition comprises from 10-25 wt % of the crosslinked polymer based on a total weight of the water-blocking composition.

4. The power cable of claim 1, wherein the water-blocking composition comprises from 20-90 wt % of the thermoplastic polymer based on a total weight of the water-blocking composition.

5. The power cable of claim 1, wherein water-blocking composition comprises from 65-85 wt % of the thermoplastic polymer based on a total weight of the water-blocking composition.

6. The power cable of claim 1, wherein the crosslinked polymer is in the form of a powder having a particle diameter from 100 μm to 600 μm.

7. The power cable of claim 6, wherein the crosslinked polymer is in the form of a powder having a particle diameter from 200 μm to 400 μm.

8. The power cable of claim 1, wherein the thermoplastic polymer and/or the crosslinked polymer are semiconductive.

9. The power cable of claim 1, wherein the thermoplastic polymer is selected from the group consisting of a polyethylene homopolymer, a polyethylene copolymer, an isobutylene homopolymer, air isobutylene copolymer, a butadiene-styrene copolymer, and an ethyl vinyl acetate polymer.

10. The power cable of claim 1, wherein the crosslinked polymer comprises a fully crosslinked polymer.

11. The power cable of claim 1, wherein the water-blocking material completely fills any interstices of the stranded conductive wire.

12. The power cable of claim 1, wherein the crosslinked polymer is in the form of a powder having a particle diameter from 200 to less than 900 μm.

13. A process for manufacturing a power cable, the process comprising:

dispersing a positive amount of up to 30 wt % of a crosslinked polymer in the form of a powder having a particle diameter less than 900 μm in a thermoplastic polymer to obtain a water-blocking composition;

pumping the water-blocking composition to impregnate stranded electrically conductive wires, to obtain a cable core.

14. The process of claim 13, wherein the pumping is carried out at a line speed greater than 250 rotations per minute.

15. The process of claim 13, wherein, during the pumping, the water-blocking composition is pumped through a heated hose.

16. The process of claim 13, wherein the pumping is carried out at a line speed of at least 400 rotations per minute.

* * * * *